United States Patent [19]

Galiasso et al.

[11] Patent Number: 5,009,768

[45] Date of Patent: Apr. 23, 1991

[54] HYDROCRACKING HIGH RESIDUAL CONTAINED IN VACUUM GAS OIL

[75] Inventors: Roberto Galiasso; Alfredo Morales; Jose A. Salazar, all of Caracas, Venezuela

[73] Assignee: Intevep, S.A., Caracas, Venezuela

[21] Appl. No.: 452,389

[22] Filed: Dec. 19, 1989

[51] Int. Cl.[5] ..... C10G 69/04

[52] U.S. Cl. ..... 208/89; 208/61; 208/210

[58] Field of Search ..... 208/59, 89, 61, 210

[56] References Cited

U.S. PATENT DOCUMENTS

| | | | |
|---|---|---|---|
| 3,098,029 | 7/1963 | Synder, Jr. | 208/61 |
| 3,809,644 | 5/1974 | Johnson et al. | 208/210 |
| 3,826,736 | 7/1974 | Kittrell | 208/61 |
| 4,302,323 | 11/1981 | Chen | 208/89 |
| 4,520,128 | 5/1985 | Morales et al. | 502/210 |
| 4,600,703 | 7/1986 | Morales et al. | 502/213 |
| 4,619,759 | 10/1986 | Myers et al. | 208/210 |
| 4,626,340 | 12/1986 | Galiasso et al. | 208/61 |
| 4,657,663 | 4/1987 | Gardner et al. | 208/210 |
| 4,713,221 | 12/1987 | Montgomery et al. | 208/68 |
| 4,797,195 | 1/1989 | Kukes et al. | 208/59 |
| 4,808,289 | 2/1989 | McDaniel et al. | 208/210 |
| 4,808,298 | 2/1989 | Peck et al. | 208/212 |
| 4,886,594 | 12/1989 | Miller | 208/210 |

*Primary Examiner*—Anthony McFarlane

*Attorney, Agent, or Firm*—Berman, Aisenberg & Platt

[57] ABSTRACT

The present invention relates to a hydrocatalytic process for treating vacuum gas oils, residual feedstocks or mixtures thereof in the presence of up to 100 ppm of V and Ni at moderate hydrogen partial pressures. The process consists of two or more stages: (a) demetallization of feedstock to levels below 10 ppm of V and Ni, and (b) hydrodenitrogenation and hydroconversion of catalysts using a combined bed, and catalytic cracking of the 370° C.± fraction to obtain gasolines. This process applies also to vacuum gas oils obtained from other processes, such as FCC, Flexicoque, etc.

20 Claims, 2 Drawing Sheets

HYDROCRACKING HIGH RESIDUAL CONTAINED IN VACUUM GAS OIL

FIELD OF THE INVENTION

Medium distillates and gasoline are produced by mild hydrocracking high-residual vacuum gas oil.

BACKGROUND

Since residual fuel consumption is continuously decreasing, there is a pressing need to find a way to convert high-residual gas oil feedstock into more-marketable products, such as diesel fuel and gasoline. Proposed alternatives include several fixed-bed catalytic treatments, such as the following:

U.S. Pat. No. 4,102,779 relates to a process for hydrotreating hydrocarbons containing metals and asphaltenes. It provides a first stage of demetallization of feedstock in the presence of a macroporous catalyst on a silica-gel matrix, and a second stage of desulfurization of feedstock in the presence of another suitable catalyst.

U.S. Pat. No. 4,048,060 also presents a two-stage hydrotreatment process which initially uses a microporous catalyst for desulfurization, and thereafter employs a larger pore diameter catalyst for subsequent demetallization.

U.S. Pat. Nos. 4,166,026 and 4,191,636 refer to one- or two-stage hydrotreatment processes (for heavy hydrocarbons with high asphaltene and metal contents) consisting of hydrometallization and selective catalytic cracking of asphaltenes in a first reaction zone, and then hydrodesulfurization of products in a second reaction zone.

On the other hand, catalysts have been developed to attempt to improve demetallization and hydrodesulfurization processes, as evidenced by U.S. Pat. No. 4,328,127 (which relates to a combination of Co and Mo supported on alumina with a specific pore volume and distribution), and by U.S. Pat. 3,630,888 (which refers to a microporous structure having access channels interstitially distributed therethrough).

In the foregoing processes fairly severe operation conditions (pressures above 1500 psi and temperatures above 380.C) are required to attain acceptable demetallization (HDM), desulfurization (HDS), and hydroconversion (HC) levels. Even use of hydrogen partial pressures below 1800 psi causes a higher deposition of coke on an active surface and thus reduces life cycles of previously-developed catalysts to less than one year.

SUMMARY OF THE INVENTION

The process of the present invention requires two or more hydrotreatment (HDT) stages, using one or more catalyst graduated beds, under operating conditions of a hydrogen partial pressure which falls below values observed in prior art. This process attains good results as to demetallization, desulfurization and conversion levels.

The graduated beds have a metal-resistant and highly-hydrogenating catalyst for a first stage. Such catalysts and their preparation are disclosed in U.S. Pat. No. 4,520,128 to INTEVEP, S.A. Suitable catalysts for hydrodenitrogenation (HDN), hydrodesulfurization and hydroconversion for the second stage and their preparation are disclosed in U.S. Pat. No. 4,600,703 also to INTEVEP, S.A. The entire disclosure of both of these patents is incorporated herein by reference.

The process of the present invention is appropriate for hydrotreatment of residual feedstocks (and mixtures thereof with vacuum gas oils of a different nature) with metal levels of up to 100 ppm and Conradson carbon levels of up to 4% by wt, using a particular combination of stable catalysts, to produce a Diesel fraction and a feed for an FCC process.

A further aspect of the process of the present invention is that the process is not limited to the use of only two catalysts in a combined bed in the second stage; it also considers the use of two or three catalysts in two or three reactors separately.

DETAILS

Figure 1:
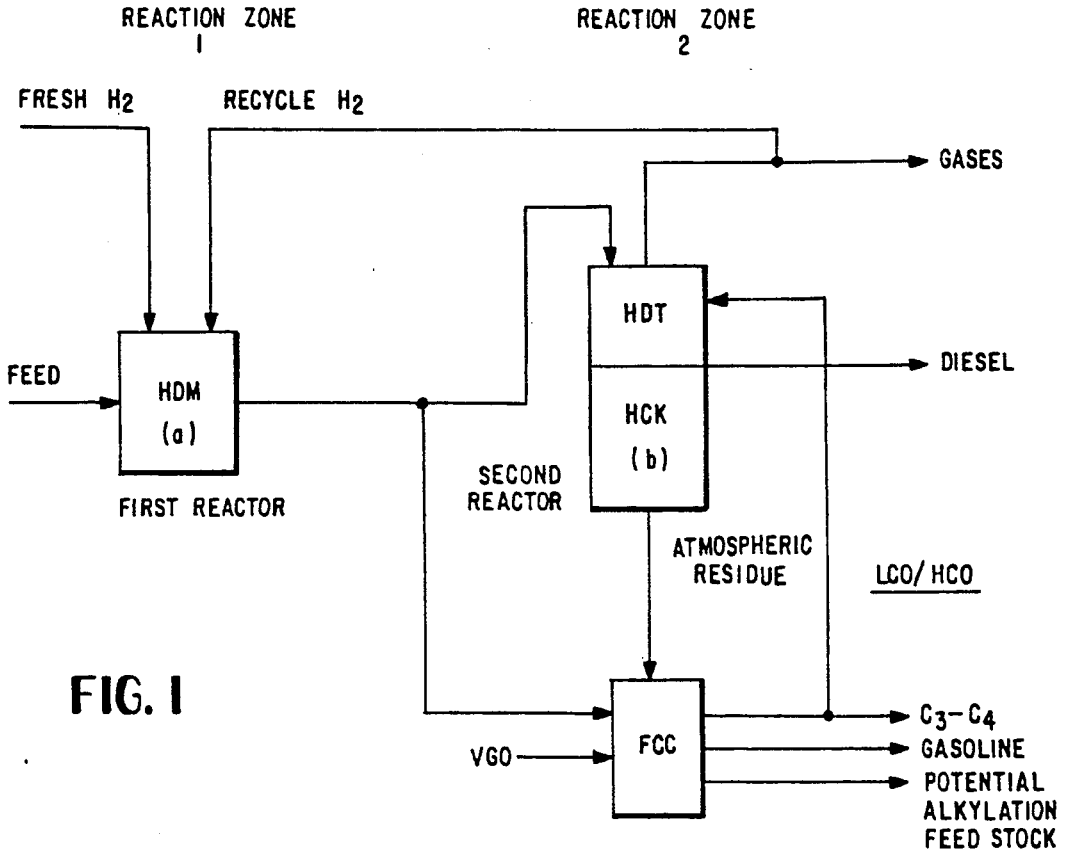
FIG. 1 is a block diagram of the HHC process of the present invention with two reactors.

According to the process of the present invention (see FIG. 1) a hydrocarbon (e.g., a complete crude or the atmospheric and vacuum residues thereof mixed with vacuum gas oils) is passed to a first reaction zone (a) for removing metals and Conradson carbon under moderate operating conditions, e.g. those comprising a temperature of from 340° C. to 430° C., a partial hydrogen pressure ranging from 200 to 2000 psi, velocities of hydrocarbon with regard to catalyst volume (LHSV) ranging from 0.3 to $4h^1$, and a hydrogenhydrocarbon ratio ranging from 300 to 1500 $Nm^3/m^3$.

The catalyst in this first reaction zone allows not only production of effluent substantially free of above-noted contaminants, but also removal of iron and sodium compounds (present in the feedstock) that could cause corrosion of equipment and pipes. Chemically, the catalyst is composed of elements selected from Groups VIb (preferably molybdenum) and VIII (preferably nickel) of the Periodic Table or a mixture thereof. Also, a phosphorus (Group Va) oxide is optionally present as an active element, and all are supported on alumina. The size of pellets ranges from 1/32 to 1/16 of an inch. They have an extruded (E), trilobate (T) or quadrilobate (Q) shape. (These catalyst shapes and how to produce them are known in the art.) The pore volume thereof is between 0.5 and 1.2 cc/gr, the surface area is between 120 and 400 $m^2/g$ and at least 60% of said pores have a pore diameter of more than 100 Å.

The product resulting from this first stage, being substantially free of metals (10 ppm maximum) and having a sulfur content reduced by at least 60%, is passed to a second reaction zone (b) under conditions similar to those in the first stage and with a second fixed catalytic bed consisting of one or more catalysts gradually distributed so that a deep denitrogenation of the feed-stock takes place (at least at levels below 1500 ppm of nitrogen) at the top, and hydroconversion to diesel fuel and naphthas of the fraction boiling above 370° C. occurs in the bottom. At the output of this second zone a product is obtained (having 25% V minimum and 60% V maximum) from the fraction boiling above 370° C., converted to diesel fuel and gasoline, and having a N and S content reduced at least by 80% and 90%, respectively, with reference to the input feedstock in the first stage.

The top of this second reaction zone may account for from 0 to 70% of the total volume of the reactor fed with a catalyst featuring: at least one hydrogenating element selected from Group VIb of the Periodic Table in a proportion of from 5 to 30% by wt. as oxide; at least one element selected from Group VIII of the Periodic Table present in a proportion of from 1 to 8% by wt. of said element with respect to the total mass of catalyst, and additionally a phosphorus oxide in a proportion ranging from 6 to 38% by wt.; all elements are supported on an alumina matrix. The catalyst has a surface area of from 140 to 250 $m^2/g$, a pore volume of from 0.45 to 0.75 cc/g; 70 to 90% of said pores haVing a pore diameter of from 30 and 300 Å.

The bottom of this same zone or other reactor may account for from 30 to 100% of the total volume of the reactor fed with a catalyst characterized as follows: at least one hydrogenating element of Group VIb of the Periodic Table, present in a proportion of from 6 to 25% by weight and in oxide form; at least one element of Group VIII of the Periodic Table, present in a proportion of from 0.5 to 8.0% by weight with respect to the total catalyst mass. All elements are supported on a silica-alumina matrix, at a ratio of $SiO_2/Al_2O_3$ ranging from 1/14 to 1.5/1 by wt. It has a surface area of from 120 to 400 $m^2/g$, a pore volume of from 0.2 to 1 cc/g, at least 60% of said volume having a pore diameter of from 20 to 150 Å.

Figure 2:
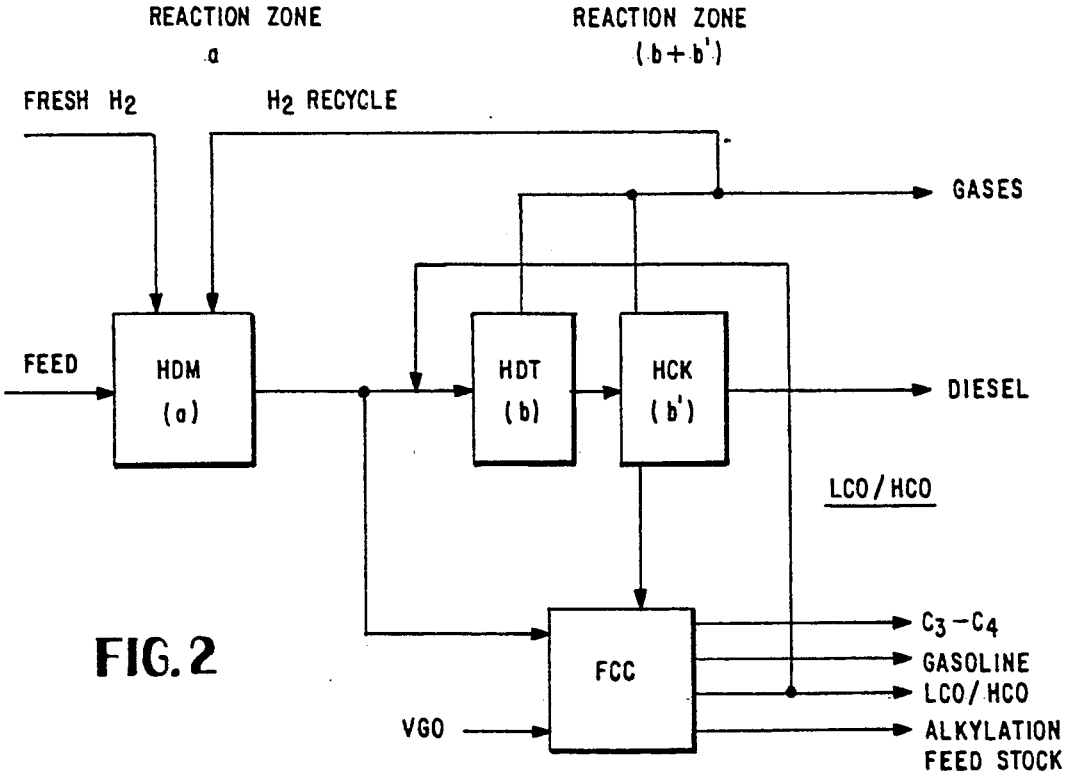
FIG. 2 is a block diagram of the HHC process with three reactors.

Optionally, the present invention further comprises feeding heavy (HCO) and/or light (LCO) cycle (residual) oil from FCC (fluid catalytic cracking well-known in the art) to the second reaction zone together with the demetallized feedstock from the first reaction zone, as shown in FIG. 1 and FIG. 2.

The following examples are merely illustrative and do not constitute any limitation to the present invention.

EXAMPLE 1

A mixture of heavy vacuum gas oil (78% by wt.) and a deasphalting oil (crude with no asphalt content or deasphalted oil) from a Jobo (a production field or location in Venezuela) crude (22% by weight) is hydrodemetallized at 390° C., a space velocity of 1 $h^{-1}$, and pressure of 1200 psi with hydrodemetallization (HDM) catalyst, the characteristics of which are shown in Table I.

TABLE I

| HDM CATALYST | |
|---|---|
| $MoO_3$ (wt %) | 8.8 |
| NiO (wt %) | 2.2 |
| $Al_2O_3$ | Support |
| Extrudate Size (inches) | 1/20 Q |
| Compact Bed Density (g/cc) | 0.6 |
| Pore Volume (cc/g) | 0.7 |
| Surface Area ($m^2/g$) | 140 |
| Mean Pore Diameter (Å) | 200 |
| Bed Attrition Resistance ($Kgf/cm^2$) | 7.8 |

The feedstock characteristics before and after this first stage of the process are set forth in Table II.

TABLE II

| Properties | Feed to 1st Reaction Zone | HDM Product |
|---|---|---|
| °API | 15.9 | 21.5 |
| V (ppm) | 57 | 4.8 |
| Ni (ppm) | 13.7 | 2.7 |
| S (wt %) | 2.707 | 0.553 |
| N (ppm) | 2.965 | 2.220 |
| Conradson C (wt %) | 1.96 | 1.0 |
| Simulated Distillation Curve; ASTM Test (v %) | | |
| IBP (initial boiling point) | | |
| −180° C. | — | — |
| 180°-370° C. | 27.3 | 38.7 |
| 370° C.+ | 72.7 | 61.3 |
| HDV (reduction in V) % | — | 91.6 |
| HDNi (reduction in Ni) % | — | 80.3 |
| HDS (reduction in S) % | — | 79.6 |
| HDN (reduction in N) % | — | 29.2 |
| HC % | — | 15.0 |

Vanadium and nickel levels are thus reduced by 92 and 80%, respectively. In addition, 80% hydrodesulfurization (HDS), 29% hydrodenitrogenation (DHDN), and 15% hydroconversion (HC) of the fraction boiling above 370° C. to medium distillates (diesel) are achieved.

EXAMPLE 2

Feedstock resulting form the first stage or demetallization is processed under the same conditions, but in the presence of a hydrodenitrogenation (HDN) catalyst, the characteristics of which are set forth in Table III.

TABLE III

| HDN CATALYST | |
|---|---|
| $MoO_3$ (wt %) | 15.6 |
| NiO (wt %) | 4.9 |
| $P_2O_5$ (wt %) | 8.5 |
| $Al_2O_3$ (wt %) | Support |
| Extrudate Size (inches) | 1/16 E |
| Compact Bed Density (g/cc) | 0.73 |
| Pore Volume (cc/g) | 0.54 |
| Surface Area ($m^2/g$) | 186 |
| Mean Pore Diameter (Å) | 116 |
| Bed Attrition Resistance ($Kgf/cm^2$) | 14.7 |

Results from this second stage are presented in Table IV.

TABLE IV

| Properties | Product from the HDN Zone | Product from the HC Zone |
|---|---|---|
| °API | 23.7 | 28.2 |
| V (ppm) | — | — |
| Ni (ppm) | — | — |
| S (wt %) | 0.109 | 0.022 |
| N (ppm) | 1135 | 239 |
| Conradson C (wt %) | 0.58 | — |
| Simulated Distillation Curve; ASTM Test (v %) | | |
| IBP-180° C. | — | 4.3 |
| 180°-370° C. | 43.3 | 55.1 |
| 370° C.+ | 56.7 | 40.6 |
| HDV (hydrodevanadiumization) % | 25 | — |
| HDNi (hydrodenickellization) % | 37 | — |
| HDS (hydrodesulfurization) % | 80.3 | 79.8 |
| HDN (hydrodenitrogenation) % | 49.7 | 78.6 |
| HC % | 8.1 | 32.0 |

As seen from Table IV, final percentages correspond to 55% by volume diesel and 4% by volume naphthas upon processing of the stock indicated in Example 1 by means of the process of the present invention. The characteristics of the 370° C.+ residue make it ideal for processing in a catalytic cracking unit.

EXAMPLE 3 the product obtained from the hydrodenitrogenation process (see also Table IV) undergoes moderate mold hydrocracking (MHCK), under the same conditions as used int he preceding examples, in the presence of a catalyst with a silica-alumina base, the characteristics of which appear in Table V.

TABLE V

| MHCK CATALYST | |
|---|---|
| $MoO_3$ (wt %) | 19.5 |
| NiO (wt %) | 2.2 |
| Group Va (wt %) | — |
| $Al_2O_3$ (wt %) | 48.8 |
| $SiO_2$ (wt %) | 24.4 |
| Extrudate Size (inches) | 1/16 E |
| Compact Bed Density (g/cc) | 0.64 |
| Pore Volume (cc/g) | 0.51 |
| Surface Area ($m^2/g$) | 183 |
| Mean Pore Diameter (Å) | 111 |
| Bed Attrition Resistance ($Kgf/cm^2$) | 15.9 |

EXAMPLE 4

Heavy crude is first hydrodemetallized using the catalyst of the first stage in Example 1, and secondly by using prior art catalyst A, the properties of which are set forth in Table VI. Operating conditions are as follows: pressure—1200 psi, temperature—400° C., and space velocity—1 $h^{-1}$.

TABLE VI

| HDM CATALYST A | |
|---|---|
| MoO (wt %) | 10 |
| NiO (wt %) | 5 |
| $Al_2O_3$ | support |
| Extrudate size (inches) | 1/32 |
| Compact Bed Density | 0.6 |
| Pore Volume (cc/g) | 0.73 |
| Surface Area ($m^2/g$) | 190 |
| Mean Pore Diameter (Å) | 154 |

Figure 3:
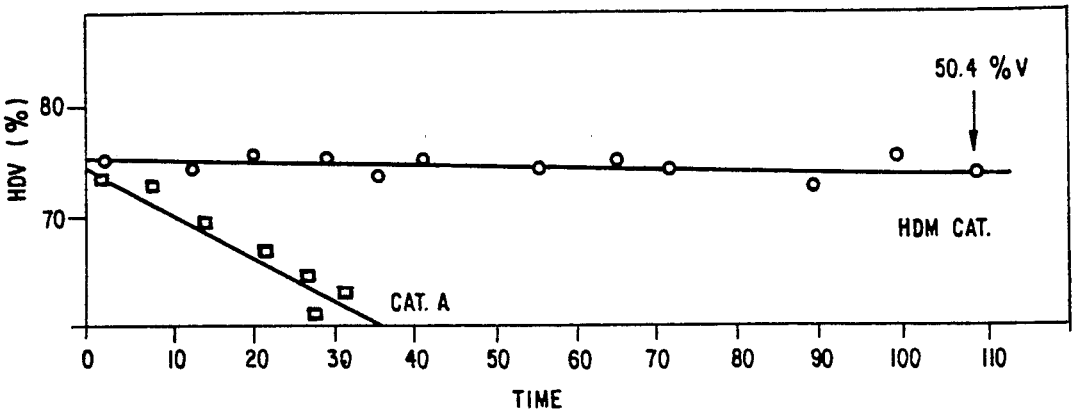
FIG. 3 is a graph of the relative activity of an HDM catalyst in stage (a) vs. known catalyst "A".

As observed from a plot of resulting data (shown in FIG. 3), the catalyst of the present invention has a life cycle 70% longer than known Catalyst A, which constitutes an obvious advantage and demonstrates its capacity for processing at low and moderate pressures.

EXAMPLE 5

The stability of a catalyst bed of the second reaction zone (consisting of 33% and 67% of catalysts represented in Tables III and V, respectively) for the subject invention and the stability of a combined bed of prior art catalysts featured in Table VII are compared at the following operating conditions; pressure—700 psi, temperature—400° C., and a gas/feedstock ratio—300 $Nm^3/m^3$.

TABLE VII

| | Catalyst B HDN | Catalyst C MHCK |
|---|---|---|
| Group VIII (wt %) | 4.7 | 3.2 |
| Group VIb (wt %) | 15.5 | 12.6 |
| $Al_2O_3$ (wt %) | Support | 48.6 |
| $SiO_2$ (wt %) | — | 25.2 |
| Extrudate Size (inches) | 1/16 E | 1/16 T |
| Area ($m^2/g$) | 270 | 311 |
| Pore Volume (cc/g) | 0.54 | 0.46 |

TABLE VII-continued

| | Catalyst B HDN | Catalyst C MHCK |
|---|---|---|
| Bed Attrition Resistance ($Kgf/cm^2$) | 11.40 | 11.86 |

Figure 4:
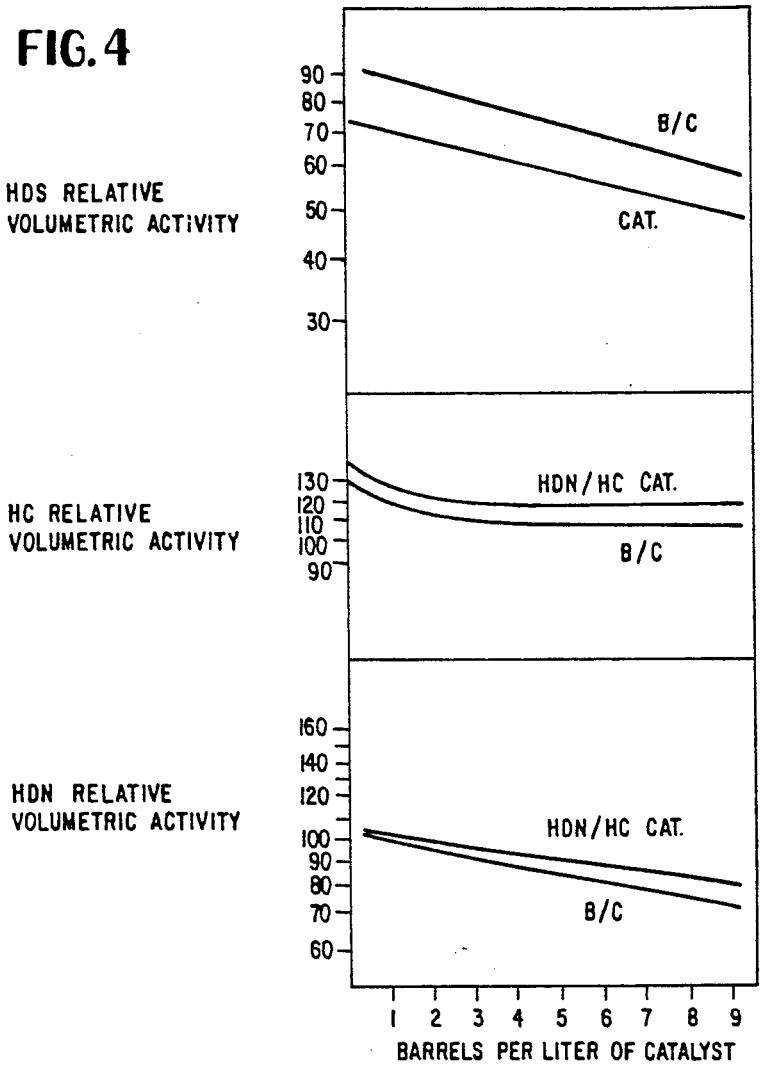
FIG. 4 is a graph showing the stability of the catalytic bed in the second reaction zone in HDS, HC and HDN (HDN/HC catalysts) vs. a combined bed (B/C) of known catalysts B and C.

The substantial advantages of the combined bed of the present invention are shown here regarding its activity and stability for hydroconversion (HC) and hydrodenitrogenation (HDN) reactions in comparison with prior art catalysts. As to hydrodesulfurization, the catalyst activity is lower, but its stability is comparable to the same catalysts (B/C), as shown in FIG. 4.

EXAMPLE 6

The stability of the combined of catalyst was studied during 45 days on stream using catalysts described in Tables I, III and V; 20% of HDM catalyst, plus 30% of HDN catalyst, plus 50% of MHCK catalyst were used.

The same feedstock and operating conditions as in Example 5 were employed. This combined bed was compared with a combined bed composed of the same amount of prior art catalysts as the claimed catalyst. The second combined bed used for a second test is composed by prior art catalyst having a similar composition and obtained from catalyst producing companies (prior art catalysts A, B, and C). The second combined bed was tested with the same operating conditions described in Example 5.

After 45 days, the temperature in the first experiment with claimed catalyst was increased only 5° C. in order to obtain the same desulfurization as originally obtained (at start-up). In the second experiment with commercial catalyst after 45 days, it was necessary to increase the temperature 15° C. in order to obtain performance equivalent to that at start up. Comparing catalyst at initial temperature:

TABLE VII

| ACTIVITY AFTER 45 DAYS ACCELERATED AGING TEST | | |
|---|---|---|
| ACTIVITY AT INITIAL TEMPERATURE | THIS INVENTION | PREVIOUS ART |
| HYDRODESULFURIZATION | 93% | 89 |
| HYDRODENITROGENATION | 60 | 55 |
| HYDRODEMETALIZATION | 100 | 100 |
| HYDROCRACKING TO DIESEL | 50 | 33 |

Table VII indicates that, after 45 days on stream, the claimed catalyst is more stable than those of the prior art. The reason was clearly described in U.S. Pat. No. 4,520,128 and in U.S. Pat. No. 4,600,703, where it was shown that catalysts with the same bulk composition but having different surface composition present better activity, due to particular active centers formed which are more stable than others. The particular combination of those catalysts yield the special catalyst stability performance, especially in hydrocracking activity.

Table VIII shows as an example the difference in surface composition of HDN catalyst claimed in comparison with catalyst B and the surface composition of MHCK catalyst in comparison with catalyst C.

TABLE VIII

| METALS RATIO IN SULPHIDED STATE | HDN CATALYST | B CATALYST (PRIOR ART) |
|---|---|---|
| $Ni_s/(Al + Ni)_s$* | 2.65 | 3.00 |
| $Mo_s/(Al + Mo)_s$* | 5.92 | 7.0 |

TABLE VIII-continued

| P/(Al + P)$_s$* | 7.79 | 5.29 |
|---|---|---|
| METALS RATIO IN SULPHIDED STATE | MHCK CATALYST | C CATALYST (PRIOR ART) |
| Ni/(Ni + Al)$_s$* | 3.35 | 4.8 |
| Mo$_s$/(Mo + Al)$_s$* | 6.5 | 8.31 |
| Si/(Si + Al)$_s$* | 22. | 34. |

(Surface composition determined by XPS according with methodology described in U.S. Pat. No. 4,600,703).
*solid state Using the information obtained with Example 5 (FIG. 4) and Example 6 (Table VII), it is possible to predict a catalyst life cycle of two years for HHC catalyst and a catalyst life cycle of only 1.2 years for prior art catalysts.

The invention and its advantages are readily understood from the preceding description. Various changes may be made in the process without departing from the spirit and scope of the invention or sacrificing its material advantages. The hereinbefore described process is merely illustrative of preferred embodiments of the invention.

What is claimed is:

1. A hydrocatalytic process for producing diesel and gasoline from high-residual vacuum gas oil, which comprises:

(a) contacting high-residual vacuum gas oil feedstock with a fixed bed hydrodemetallization (HDM) catalyst composed of elements selected from Groups VIb and VIII of the Periodic Table in the presence of hydrogen and under moderate operating conditions to achieve at least 80% by weight of metal removal;

(b) conveying product from step (a) together with light cycle oil (LCO), heavy cycle oil (HCO) or a mixture thereof from fluid catalytic cracking (FCC) to a second catalyst bed, which is composed of a combination of catalysts, consisting of elements selected from Groups VIb, VIII and Va of the Periodic Table, and wherein said catalysts are present in proportions ranging from 0 to 70% by volume at the top and from 30 to 100% by volume at the bottom of the second catalyst bed, and passing said product through said second catalyst bed in the presence of hydrogen and under operating conditions substantially the same as those in step (a);

(b') transmitting product from step (b) through a third catalyst bed consisting of an element selected from Groups VIb and VIII of the Periodic Table supported on a silica-alumina base, and where said catalysts are present in an amount which varies from 30 to 50% of total catalyst volume, and passing said product through the third catalyst bed in the presence of hydrogen and under substantially the same or different operating conditions from those of step (a); and (c) separating diesel fuel and naphthas from the product from step (b) or from step (b'), recovering the diesel fuel and then subjecting the resulting product to catalytic cracking (FCC).

2. A process according to claim 1 wherein the catalyst in step (a) consists essentially of active elements supported on alumina and wherein essential active elements are nickel and molybdenum, in proportions of at least 8% by weight and 2% by weight, respectively, each as an oxide or sulfide.

3. A process according to claim 1 wherein catalyst in stage (a) has a surface area of from 120 to 400 $m^2/g$, a pore volume of from 0.5 to 1.2 cc/g, and wherein at least 60% of the catalyst volume has a pore diameter greater than 100 Å.

4. A process according to claim 1 wherein the moderate operating conditions of step (a) comprise a partial hydrogen pressure of from 200 to 2000 psi, a temperature of from 340° C. to 430° C., a space velocity of from 0.1 to 4 $h^{-1}$, and a hydrogen/hydrocarbon ratio of from 300 to 1300 $Nm^3/m^3$.

5. A process according to claim 4 wherein the moderate operating conditions in step (a) comprise a partial hydrogen pressure of from 400 to 1800 psi, a temperature of from 350° C. to 420° C., a space velocity of from 0.3 to 3.5 $h^{-1}$, and a hydrogen/feedstock ratio of from 500 to 1300 $Nm^3/m^3$.

6. A process according to claim 1 wherein the catalyst in step (b) at the top of the second reaction zone consists essentially of active elements supported on alumina, wherein essential active elements are (1) from 5 to 30% by weight of one or more elements from Group VIb of the Periodic Table in oxide form, (2) from 1 to 8% by weight of one or more elements from Group VIII of the Periodic Table and (3) from 6 to 38% by weight of phosphorus oxide.

7. A process according to claim 1 wherein the catalyst at the top of the catalyst bed in step (b) has a surface area of from 140 to 250 $m^2/g$, a pore volume of from 0.45 to 0.75 cc/g, and wherein from 70 to 98% of the catalyst volume has a pore diameter of from 30 to 300 Å.

8. A process according to claim 1 wherein the catalyst in the bottom of the second catalyst bed in step (b) or in step (b') comprises, as active elements, from 6 to 25% by weight of one or more elements from Group VIb of the Periodic Table in oxide form and from 0.5 to 8% by weight of one or more elements from Group VIII of the Periodic Table in oxide form; each active element being supported on silica-alumina, the $SiO_2/Al_2O_3$ weight ratio of which ranges from 1.0/14 to 1.5/1.

9. A process according to claim 1 wherein the catalyst in the bottom of the catalyst bed in step (b) or in step (b') has a surface area of from 120 to 400 $m^2/g$ and a pore volume of from 0.2 to 0.6 cc/g; at least 60% of the volume of said catalyst having a pore diameter of from 20 to 150 Å.

10. A process according to claim 1 wherein the operating conditions for step (b) or in step (b') comprise a partial hydrogen pressure of from 100 to 2000 psi, a temperature of from 320° C. to 1 420° C., a space velocity of from 0.1 to 3 $h^{-1}$, and a hydrogen/hydrocarbon ratio of from 100 to 1500 $Nm^3/m^3$.

11. A process according to claim 10 wherein operating conditions in step (b) or in step (b') comprise a partial hydrogen pressure of from 300 to !800 psi, a temperature of from 340° C. to 415° C., a space velocity of from 0.2 to 2.5 $h^{-1}$, and a hydrogen/feedstock ratio of from 200 and 1300 $Nm^3/m^3$.

12. A process according to claim 1 which comprises converting a 370° C.+ boiling paint fraction during step (b) or step (b') to a degree of from 25 to 60% by volume.

13. A process according to claim 1 which comprises converting a feedstock with a carbon Conradson content higher than 2% wt., a metal content higher than 50 ppm and aromatics content higher than 50% wt, into a product wherein 25 to 60% by volume has a boiling point of at most 350° C., with a catalyst life in excess of one and half years.

14. A process according to claim 1 which comprises coverting the feedstock of claim 1 in two stages using the same operating pressure ranging from 700 psig to 1800 psig to obtain 30 to 60% by volume of diesel fraction.

15. A process according to claim 1 which comprises converting the feedstock of claim 13 in two stages using different pressures ranging from 500 to 1000 psig in the first stage and from 1000 to 1800 psig in the second stage.

16. A process according to claim 1 where the catalyst of step (a) has a chemical surface composition as measured by X-Ray Photoelectron Spectroscopy (XPS) Technique as follows: Group VIb/(Group VIb+Al) of from 3.0 to 9.7, Group VIII/(Group VIII+Al) of from 0.7 to 6.0, and P/(P+Al) of from 6.0 to 9.2.

17. A process according to claim 1 where the catalyst of step (b) has a chemical surface composition as measured by XPS technique as follows: Groups VIb/(Group VIb+Al) of from 0.3 to 9.7, Group VIII/(Group VIII+Al) of from 0.7 to 6.0, and P/(P+Al) of from 6.0 to 11.0.

18. A process according to claim 1 where the catalyst of step (b) or step (b') has a chemical surface composition as measured by XPS Technique as follows: Group VIb/(Group VIb+Al) of from 4 to 7, Group VIII/(Group VIII+Al) of from 2 to 5, and Si/(Si+Al) of from 18 to 28.

19. A process according to claim 1 wherein step (b) and step (b') are conducted in separate distinct reactors.

20. A hydrocatalytic process according to claim 1 wherein part of the product from step (a) is subjected to catalytic cracking with product from step (b').

* * * * *

UNITED STATES PATENT AND TRADEMARK OFFICE

CERTIFICATE OF CORRECTION

PATENT NO. : 5,009,768

DATED : April 23, 1991

INVENTOR(S) : GALIASSO, et al.

It is certified that error appears in the above-identified patent and that said Letters Patent is hereby corrected as shown below:

Title page, Abstract [57], line 19, "±" should read --+--. Column 1, line 45, "380.C" should read --380°C--. Column 2, line 36, "$4h^1$" should read --$4h^{-1}$--; "hydrogenhydrocarbon" should read --hydrogen-hydrocarbon--. Column 3, line 16, "haVing" should read --having--. Column 4, line 21, "(DHDN)" should read --(HDN)--; line 27, "form" should read --from--; line 58, "25" should be immediately therebelow in line 59; line 60, "37" should be immediately therebelow in line 61. Column 5, line 7, "mold" should read --mild--; line 9, "int he" should read --in the--. Column 6, line 16, "combined of" should read --combined--. Column 8, line 52, "1 420" should read --420--; line 57, "!800" should read --1800--; line 62, "paint" should read --point--. Column 9, line 4, "coverting" should read --converting--; line 9, "the feedstock of claim 13" should read --a feedstock, with a carbon Conradson content higher than 2% wt., a metal content higher than 50 ppm and aromatics content higher than 50% wt., --.

Signed and Sealed this

Eighth Day of December, 1992

*Attest:*

DOUGLAS B. COMER

*Attesting Officer*

*Acting Commissioner of Patents and Trademarks*